US008152356B2

(12) United States Patent
Guo

(10) Patent No.: US 8,152,356 B2
(45) Date of Patent: Apr. 10, 2012

(54) SPRAY BLENDED EMULSIFIER

(76) Inventor: Tzer-Huang Guo, Keelung (TW)

( * ) Notice: Subject to any disclaimer, the term of this patent is extended or adjusted under 35 U.S.C. 154(b) by 430 days.

(21) Appl. No.: 12/501,436

(22) Filed: Jul. 12, 2009

(65) Prior Publication Data

US 2011/0007601 A1 Jan. 13, 2011

(51) Int. Cl.
*B01F 5/10* (2006.01)

(52) U.S. Cl. ..... 366/136; 366/142

(58) Field of Classification Search ..... 366/136, 366/137, 142, 145
See application file for complete search history.

(56) References Cited

U.S. PATENT DOCUMENTS 24,686 A * 7/1859 Wicks ..... 99/458
954,103 A * 4/1910 Irey ..... 68/184
2,685,499 A * 8/1954 Hood ..... 423/554
3,166,020 A * 1/1965 Cook ..... 417/198
2003/0137895 A1* 7/2003 Hummer ..... 366/137
* cited by examiner

*Primary Examiner* — David Sorkin

(57) ABSTRACT

A spray blended emulsifier comprises: a blending kettle, a feeding tank, a sprayer, a residuum pump, a thermal resistance probe, a tee valve and discharge tube; the charge pipe underneath said feeding tank is mounted on the upper cover of the blending kettle, and extended into the blending kettle. The sprayer contains a spraying channel and a guide plate; the spraying channel contains a nozzle inlet, a turbulent path, a blending chamber and a nozzle outlet connected in series; the nozzle inlet is of a funnel pattern. The spray blended emulsifier is structurally characterized by that, spraying channel and guide plate are mounted into the sprayer, a turbulent path is placed in the spraying channel, and the liquid flow has a Reynolds number larger than 3000.

3 Claims, 1 Drawing Sheet

SPRAY BLENDED EMULSIFIER

BACKGROUND OF INVENTION

1. Field of the Invention

This invention relates generally to a spray blended emulsifier mixing two or more liquid medium.

2. Description of Related Art

Two kinds of liquid medium with different phases can be mixed into a uniform mixed liquid under a certain acting force. Such a mixed liquid can be stored for a certain period of time under a standstill state; generally, the storage period of the mixed liquor is closely related to both the emulsifying agent and the emulsification equipment. However, due to different operating principles, existing conventional emulsifying equipments, such as mechanical agitating, ejecting, supersonic vibrating and magnetic types, are not ideally suitable for the mixed liquors. The new centrifugal high-speed cutting emulsifier cannot be widely applied to SMEs due to structural complexity, higher cost and energy consumption as well as lower efficiency.

In recent years, many countries have focused on R&D of new energy resources due to global shortage of oil resources. In particular, more research efforts on emulsification of fuels have been made for the purpose of fuel modification, energy-saving and environmental protection. Many countries have also invested heavily in an attempt to produce a simple, low-cost, low energy-consumption and highly efficient emulsifier for meeting the market demands.

Therefore, the inventor has provided the present invention of practicability after deliberate design and evaluation based on years of experience in the production, development and design of related products.

SUMMARY OF THE INVENTION

This invention provides a spray blended emulsifier, which features simple construction, lower cost, lower energy consumption and satisfactory emulsifying effect, making it suitable for not only emulsification of fuels but also for applications in food, pharmaceuticals and other industries.

The spray blended emulsifier of the invention comprises: a blending kettle, a feeding tank, a sprayer, a residuum pump, a thermal resistance probe, a tee valve and discharge tube; the charge pipe underneath said feeding tank is mounted on the upper cover of the blending kettle, and extended into the blending kettle; said sprayer contains a spraying channel and a guide plate; the spraying channel contains a nozzle inlet, a turbulent path, a blending chamber and a nozzle outlet connected in series; the nozzle inlet is of a funnel pattern, and the turbulent path is sized by 1.2-3 mm; a liquid flow port is arranged separately at both sides of the wall of the blending chamber, the guide plate is arranged vertically on the spraying channel, and located between the liquid flow port and nozzle outlet; small orifices are densely configured on the guide plate; the orifices are of an aperture of 1-3 mm, and the aperture ratio of the guide plate is 60-80%; a screen is placed under the blending kettle; the residuum pump is placed on a connecting tube between the tee valve and the bottom discharge port of the blending kettle; the discharge tube is connected with the tee valve; the thermal resistance probe is permanently arranged within the blending kettle, and connected with the temperature indicator via a wire threading the upper cover of the blending kettle.

The spray blended emulsifier of the invention is structurally characterized by that, spraying channel and guide plate are mounted into the sprayer, a turbulent path is placed in the spraying channel, and the liquid flow has a Reynolds number (i.e. the ratio of inertia force to internal frictional force during flow of liquid) larger than 3000, Thus, the turbulent flow of the liquid will lead to impaction and friction of molecules in the turbulent path, so that the liquids can be blended and the misty emulsifying agent of fine particles is sprayed to the blending chamber from the turbulent path. With the arrangement of guide plate, a pressure difference is generated inside and outside the blending chamber, such that a small-range turbulence of the liquids is formed at the liquid flow port to ensure a better emulsification effect. Without lamination and deposition, the blended emulsifying agent can be stored over 2 years. In the entire circulatory spraying and emulsifying process, the reaction temperature will rise gradually without need of additional heater, helping to realize energy conservation.

Hence, this invention features simple construction, lower cost, lower energy consumption and satisfactory emulsifying effect, making it suitable for not only emulsification of fuels but also for preparing emulsifying agent in food and pharmaceuticals industries.

DETAILED DESCRIPTION OF THE INVENTION

Figure 1:
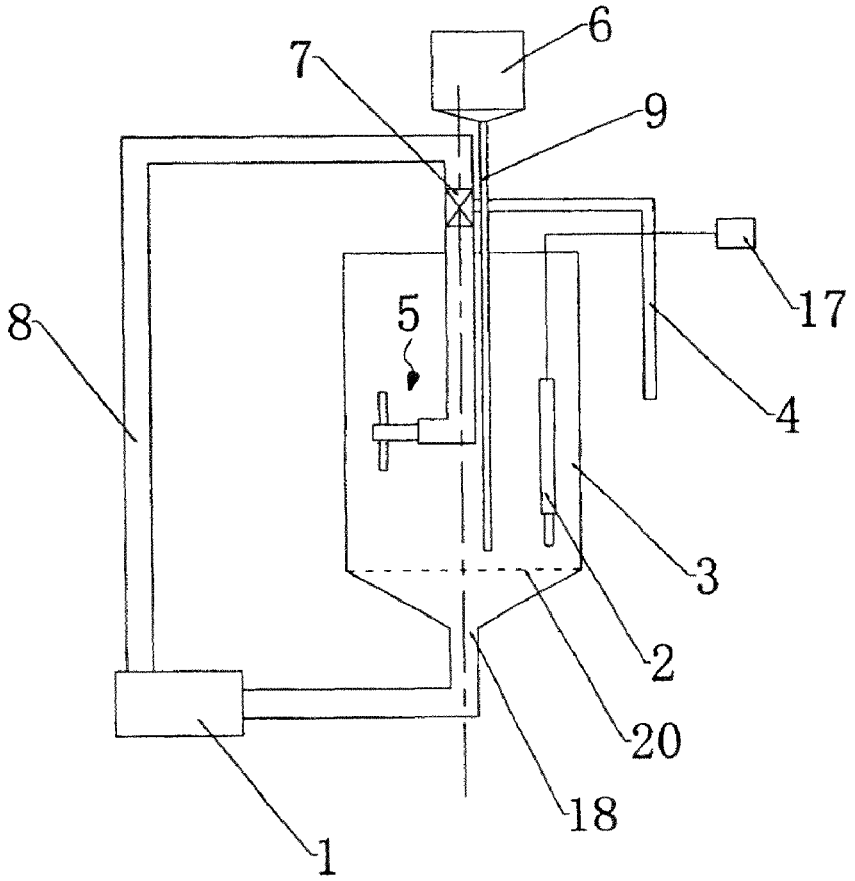
FIG. 1 shows a structural view of the spray blended emulsifier of the invention.
Figure 2:
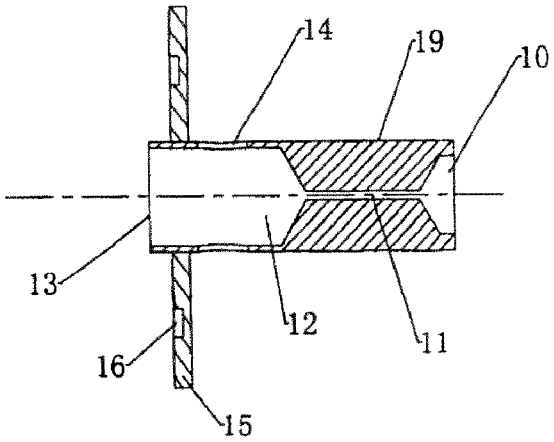
FIG. 2 shows a longitudinal sectional view of the sprayer of FIG. 1.
Figure 3:
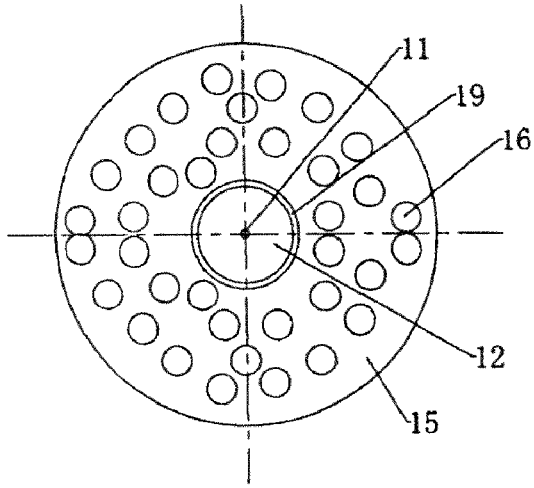
FIG. 3 shows a left-hand view of guide plate of FIG. 2.

Referring to FIGS. 1~3, the spray blended emulsifier of the invention mainly comprises: a blending kettle 3, a feeding tank 6, a sprayer 5, a residuum pump 1, a thermal resistance probe 2, a tee valve 7 and discharge tube 4; the charge pipe 9 underneath said feeding tank 6 is mounted on the upper cover of the blending kettle 3, and extended into the blending kettle 3; said sprayer 5 contains a spraying channel 19 and a guide plate 15; the spraying channel 19 contains a nozzle inlet 10, a turbulent path 11, a blending chamber 12 and nozzle outlet 13 connected in series; the nozzle inlet 10 is of a funnel pattern, and the turbulent path 11 is sized by 1.2-3 mm; a liquid flow port 14 is arranged separately at both sides of the wall of the blending chamber 12, the guide plate 15 is arranged vertically on the spraying channel 19, and located between the liquid flow port 14 and nozzle outlet 13; small orifices 16 are densely configured on the guide plate 15; the orifices are of an aperture of 1-3 mm, and the aperture ratio of the guide plate is 60-80%; a screen 20 is arranged under the blending kettle to remove the impurities; the residuum pump 1 is placed on a connecting tube 8 between the tee valve 7 and the bottom discharge port 18 of the blending kettle 3; the residuum pump 1 is used for pumping the liquid after circulatory spraying and emulsification; the advantage of the residuum pump 1 is that the pump can run smoothly even in the case of small residuum in the liquid. The discharge tube 4 is connected with the tee valve 7; the thermal resistance probe 2 is permanently arranged within the blending kettle 3, and connected with the temperature indicator 17 via a wire threading the upper cover of the blending kettle 3, so as to indicate the temperature rise during circulatory spraying and emulsification process.

The operating principle of the spray blended emulsifier of the invention is as follows: after the raw liquids, such as: fuel and emulsifying agent, enter into the blending kettle 3 through the feeding tank 6 and charge pipe 9, open the tee valve 7 and the nozzle inlet 10, close the discharge tube 4 and activate the residuum pump 1; the blended liquid flowing from bottom discharge port 18 of the blending kettle 3 via the screen 20 will enter into the nozzle inlet 10 of the sprayer 5 through the residuum pump 1, the connecting tube 8 and tee valve 7, and then flow into the turbulent path 11 in a turbulence state. Hence, the liquid flow will lead to impaction and friction of molecules in the turbulent path 11, so that the liquids can be blended and the particles are refined, and misty emulsifying agent of fine particles is sprayed to the blending chamber 12 from the turbulent path 11, and ejected out of the nozzle outlet 13. A portion of raw liquid penetrates the small orifices 16 on the guide plate 15 and enters into the exterior of the blending chamber 12, such that a pressure difference is generated inside and outside the blending chamber 12, and small-range turbulence of the liquids is formed at the liquid flow port to ensure a better emulsification effect. In such case, a circulatory loop is shaped if the blended liquid flows through the bottom discharge port 18 of the blending kettle 3, the residuum pump 1 and sprayer 5. In the repetitive circulatory spraying and emulsifying process, the temperature within the blending kettle 3 rises gradually. With the help of thermal resistance probe 2, the temperature is indicated by the temperature indicator 17. After completion of blending& emulsifying of the raw liquid, close the tee valve 7 and nozzle inlet 10, and then open the discharge tube 4; next, the emulsifying agent of the fuel is discharged from the discharge tube 4.

The invention claimed is:

1. A spray blended emulsifier, wherein the emulsifier comprises of: a blending kettle, a feeding tank, a sprayer, a residuum pump, a thermal resistance probe, a tee valve and discharge tube; a charge pipe underneath said feeding tank is mounted on the upper cover of the blending kettle, and extended into the blending kettle; said sprayer contains a spraying channel and a guide plate; the spraying channel contains a nozzle inlet, a turbulent path, a blending chamber and nozzle outlet connected in series; the nozzle inlet is of a funnel pattern, and the turbulent path is sized by 1.2-3 mm; a liquid flow port is arranged separately at both sides of the wall of the blending chamber, the guide plate is arranged vertically on the spraying channel, and located between the liquid flow port and nozzle outlet; small orifices are densely configured on the guide plate; the residuum pump is placed on a connecting tube between the tee valve and the bottom discharge port of the blending kettle; the discharge tube is connected with the tee valve; the thermal resistance probe is permanently arranged within the blending kettle, and connected with the temperature indicator via a wire threading the upper cover of the blending kettle.

2. The spray blended emulsifier as claimed in Claim 1, wherein the spray blended emulsifier is characterized by that, small orifices on the guide plate are of an aperture of 1-3 mm, and the aperture ratio of the guide plate is 60-80%.

3. The spray blended emulsifier as claimed in claim 1, wherein the spray blended emulsifier is characterized by that, a screen is arranged under the blending kettle.

* * * * *